United States Patent [19]

LaBove et al.

[11] 4,189,634

[45] Feb. 19, 1980

[54] SLIDE RULE FOR HYPERALIMENTATION DOSAGE COMPUTATIONS

[76] Inventors: Larry D. LaBove, 7490 Brompton, Houston, Tex. 77025; Robert F. Mitchell, III, 6109 Annapolis, Houston, Tex. 77005

[21] Appl. No.: 736,698

[22] Filed: Oct. 29, 1976

[51] Int. Cl.[2] ..... G06G 1/02; G06C 3/00

[52] U.S. Cl. ..... 235/70 A; 235/85 R

[58] Field of Search ..... 235/70 A, 89 R, 84, 235/85 R

[56] References Cited

U.S. PATENT DOCUMENTS

| | | | |
|---|---|---|---|
| 2,171,873 | 9/1939 | Gould | 235/89 R |
| 3,627,199 | 12/1971 | Hill | 235/85 R |
| 3,747,847 | 7/1973 | Cohen | 235/89 R |
| 3,814,308 | 6/1974 | Kolan | 235/70 A |
| 3,859,511 | 1/1975 | Walker | 235/89 R |
| 4,037,782 | 7/1977 | Jackson | 235/84 |

*Primary Examiner*—Stephen J. Tomsky

*Attorney, Agent, or Firm*—Pravel, Gambrell, Hewitt, Kirk, Kimball & Dodge

[57] ABSTRACT

The present invention provides a slide rule for use by physicians, pharmacists and other medical or hospital personnel in determining and computing dosages to be administered by hyperalimentation. Total calories in the dosage, as well as final percent concentrations of base components and nutrient solutions in the dosage, may be determined.

6 Claims, 6 Drawing Figures

SLIDE RULE FOR HYPERALIMENTATION DOSAGE COMPUTATIONS

BACKGROUND OF THE INVENTION

1. Field of Invention

The present invention relates to slide rules for hyperalimentation or parenteral nutrition dosage computations.

2. Description of Prior Art

Hyperalimentation, also known as total parenteral nutrition, is a term defining the technique of intravenous therapy for providing nutrition to persons who are undergoing chemotherapy, which often causes these persons to reject normal nutrition, and to persons who, as a result of trauma, such as surgery, burns or shock, or other complications, are in a catabolic state of malnutrition. In prescribing dosages, it is useful for the physician to evaluate the effect of a particular dosage and component concentration on the patient. It is also useful for a pharmacist in labelling hyperalimentation solutions to known particular dosages and component concentrations.

Conventional general purpose slide rules, such as in U.S. Pat. No. 2,500,460, were not suitable for these purposes, since the indicia thereon were positioned according to logarithmic numerical relationships rather than according to the type of solutions being prescribed and administered. Other special purpose slide rules, such as in U.S. Pat. Nos. 1,488,823 and 3,814,308, were specially designed for performing calculations based on particular types of fluids and components and did not lend themselves to medical dosage computations. Finally, the slide rule disclosed in U.S. Pat. No. 3,747,847 gave estimated 24-hour therapy figures for intravenous therapy. However, this structure was based on which of eight particular physical conditions a patient might be in, and the patient's body weight. For these given conditions, the amounts of materials available in a single particular solution, on which the slide rule was based, was readily ascertained. However, for a particular patient and physical condition, the physician could not evalute the relative merits and effects of therapy using one of several alternative solutions for the patient, based on the components of the solutions, as well as the caloric content of the solutions.

SUMMARY OF THE INVENTION

Briefly, the present invention provides a new and improved slide rule for hyperalimentation dosage computations, such as the calories available from chosen or proposed components or additives to a hyperalimentation solution, as well as the final percent of each base component or additive in the total volume of the solution. The slide rule includes a jacket member and an inner slide member.

For calorie availability computations, the jacket member has a calorie indicator face panel and the slide member has a calorie availability display surface. The calorie availability display surface has nomographs, and the calorie indicator face panel has apertures adjacent these nomographs with indicia adjacent the apertures so that the slide member may be moved with respect to the jacket member to permit the calories per unit volume in a solution to be determined, so that for a particular volume of solution, the total calories available in the solution may be quickly determined.

For final percentage computations, the jacket member has a percentage indicator face panel and the slide member has a final percentage display surface. The final percentage display surface has scales thereon for various volumes of hyperalimentation solution and for final percentages represented by components of the fluid, while the percentage indicator face panel has apertures adjacent the scales and scale indicia adjacent the apertures so that the slide member may be moved with respect to the jacket to permit the final percentage of a particular component in the total volume of the solution to be determined.

It is an object of the present invention to provide a new and improved slide rule for hyperalimentation dosage computations.

Figure 1:
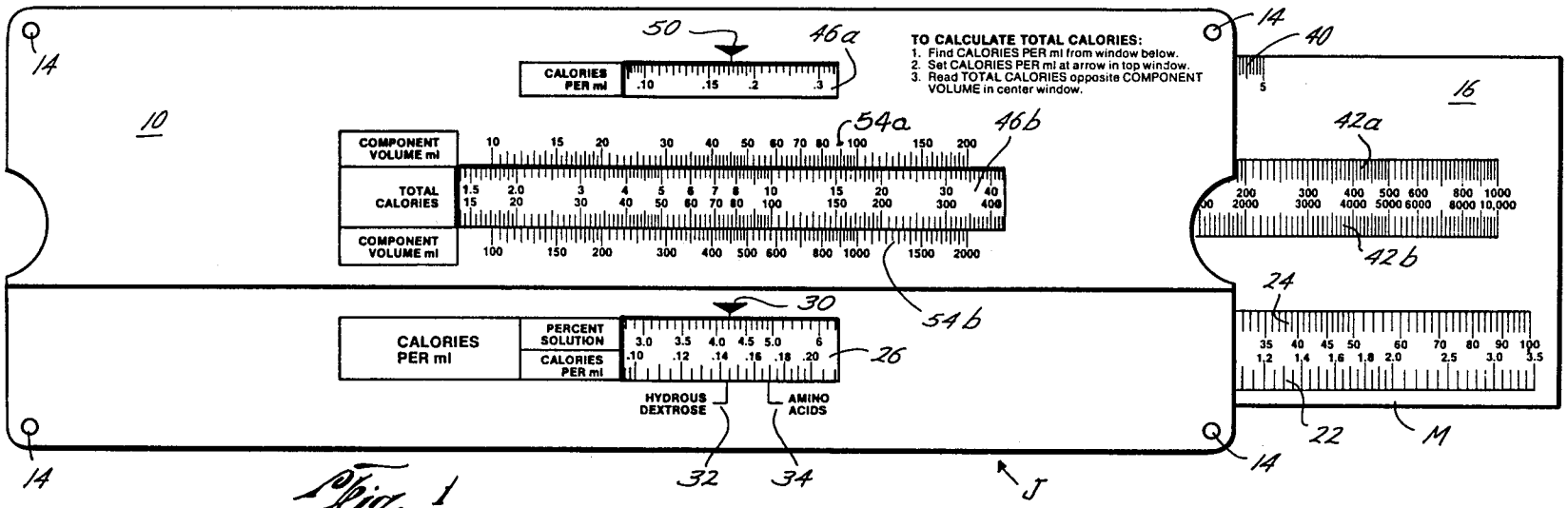
FIG. 1 is a plan view of a calorie availability face panel and co-acting display surface of a slide rule of the present invention.

DESCRIPTION OF THE PREFERRED EMBODIMENT:

In the drawings, a slide rule according to the present invention for computation of dosages in prescribing hyperalimentation solutions, is shown which permits physicians, pharmacists and the like to determine and compute dosages of various chosen or proposed solutions and additives to be administered by hyperalimentation. Total calories in the dosage, as well as final percent concentrations of base components and nutrient solutions in the dosage may be determined.

Figure 2:
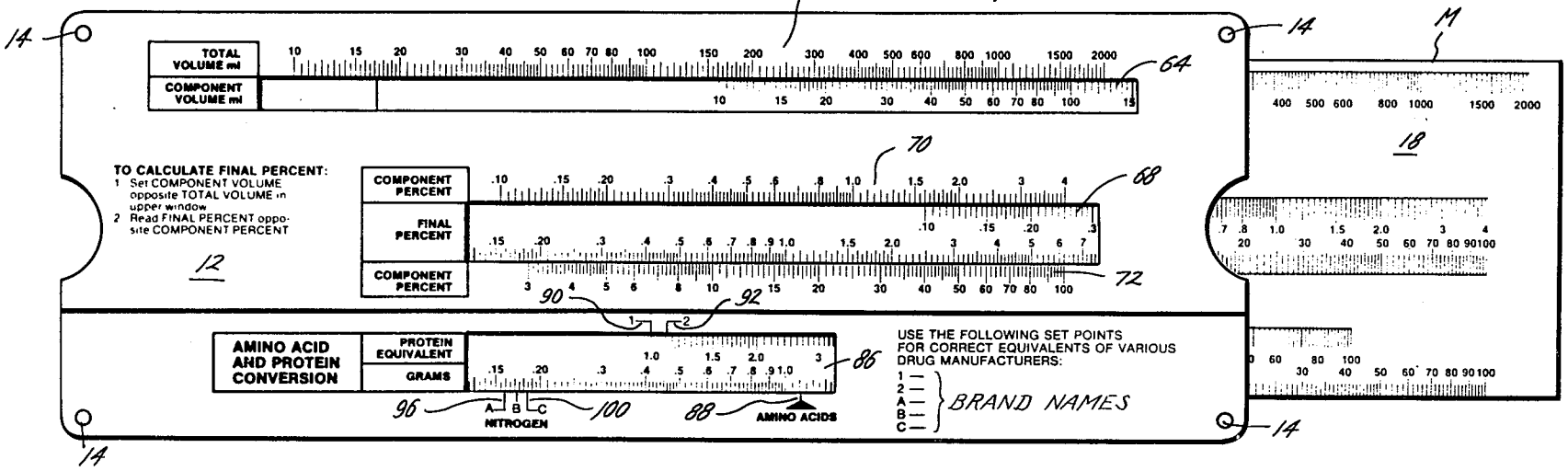
FIG. 2 is a plan view of a percentage indicator face panel and co-acting display surface of a slide rule of the present invention.
Figures 3, 4:
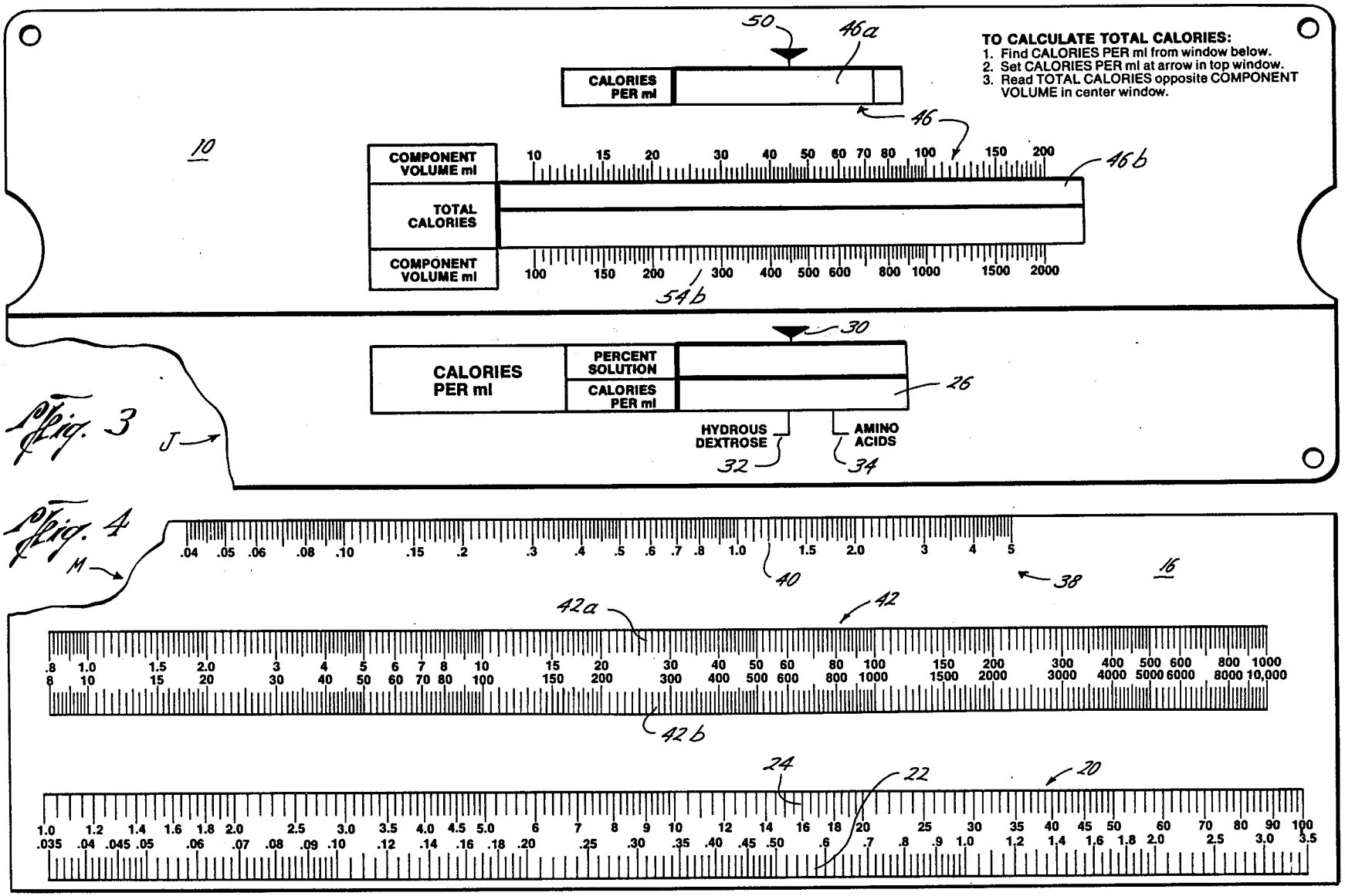
FIG. 3 is a plan view of the panel of FIG. 1.
FIG. 4 is a plan view of the display surface of FIG. 1.

Considering the slide rule more in detail (FIGS. 1 and 2), a jacket member J and a slide member M comprise the basic moving parts thereof. The jacket member J and the slide member M may be made from paper, fiberboard, plastic or other suitable material and may be coated with a suitable protective material, if desired. The jacket member J has a calorie indicator face panel 10 (FIG. 1) and a percentage indicator face panel 12 (FIG. 2), mounted with respect to each other by brads 14 or other suitable means at the corners thereof. The face panels 10 and 12 of the jacket member J are spaced with respect to each other to permit the slide member M to move laterally inwardly and outwardly with respect to the jacket member J during computation of dosages, as will be set forth. With the slide member M removed (FIGS. 3 and 5), apertures in one of the face panels are visible through the other face panel.

The slide member M includes a calorie availability display surface 16 (FIGS. 1 and 4) for use in conjunction with the calorie indicator face panel 10 in determining total calories available from a proposed hyperalimentation solution. Similarly, the slide member M includes a final percentage display surface 18 (FIGS. 2 and 6) for use in conjunction with the percentage indicator face panel 12 in determining the final percentage of a component in the total volume of the solution proposed to be, or being, administered to be determined.

Considering now the calorie availability display surface 16, a first nomograph 20 (FIG. 4) is set forth thereon defining calories per unit volume, as indicated by a lower scale portion 22 thereof, as a function of the component percentage solution of a hyperalimentation solution, indicated by an upper scale 24. The first nomograph 20 of the calorie availability display surface 16 is formed on the slide member M so that the numbers on the nomograph 20 are visible through a first aperture 26 formed on the calorie indicator face panel 10 (FIG. 3) to permit viewing of the nomograph 20.

Indicia in the form of an arrow 30, line designator 32 for hydrous dextrose and line designator 34 for amino acids are formed on the calorie indicator face panel 10 adjacent the first aperture 26. When the arrow 30 adjacent the aperture 26 is aligned with a particular number on the scale 24 of the nomograph 20, the markers 32 and 34 permit the calories per unit volume, preferably calories per milliliter, to be determined from the lower scale 22 of the nomograph 20, depending upon the particular type of proposed fluid component of the hyperalimentation solution. The marker 32 permits the calories per unit volume for hydrous dextrose to be determined from the nomograph 20, while the marker 34 permits a similar determination to be made for amino acids.

The calorie availability display surface 16 further includes a second nomograph 38 having an upper scale portion 40 (FIG. 4) setting forth calories per unit volume and a two part lower scale portion 42, setting forth total calories available in the range of from 0.8 to 1000 on a first portion **42*a* thereof and total calories in the range of from 8 to 10,000, a tenfold increase from scale 42*a*, on a second portion 42*b* thereof. The calorie indicator face panel 10 has a second, two part, aperture group 46 formed therein adjacent the nomograph 38 of the display surface 16. Due to the two part scale portion 42, the aperture group 46 includes an upper aperture 46*a* and a lower aperture 46*b* for viewing the scale 40, and the portions 42*a* and 42*b* of the lower scale 42, respectively. The upper aperture 46*a* has indicia in the form of a pointer 50 formed thereon adjacent the upper portion 40 of the nomograph 38 so that a calories per unit volume figure on the scale 40 may be aligned with the indicator 50**.

The lower aperture **46*b* of the second aperture 46 has indicia in the form of a two-portion scale, an upper scale 54*a*, for alignment with the scale portion 42*a*, setting forth a range of component volume values of from ten to two hundred milliliters, and a lower scale portion 54*b* setting forth component volume values in the range of from one hundred to two thousand millileters, or a tenfold increase in the scale 54*a*, for alignment with the lower portion 42*b* of the second scale 42. With a particular calories per unit volume figure on the upper scale 40 of the nomograph 38, and a stated or chosen component volume in milliliters for a proposed component nutritive solution in a given or proposed hyperalimentation solution, the total calories available of the proposed solution may be read from the scale 42 of the nomograph 38**.

Accordingly, for a proposed or stated hyperalimentation solution, the slide member M is moved with respect to the jacket member J so that the calories per unit volume for a particular component or additive may be determined from nomograph 20 through aperture 26, using arrow 30 and markers 32 or 34, as the case may be. The slide member M is then moved so that the calories per unit volume, determined on nomograph 20, on scale 40 is aligned with pointer 50. With the slide member M in this position, for a component volume value on scale **54*a* or 54*b*, the total calories available from such component volume may be read from nomograph 42 through aperture 46*b***.

Figures 5, 6:
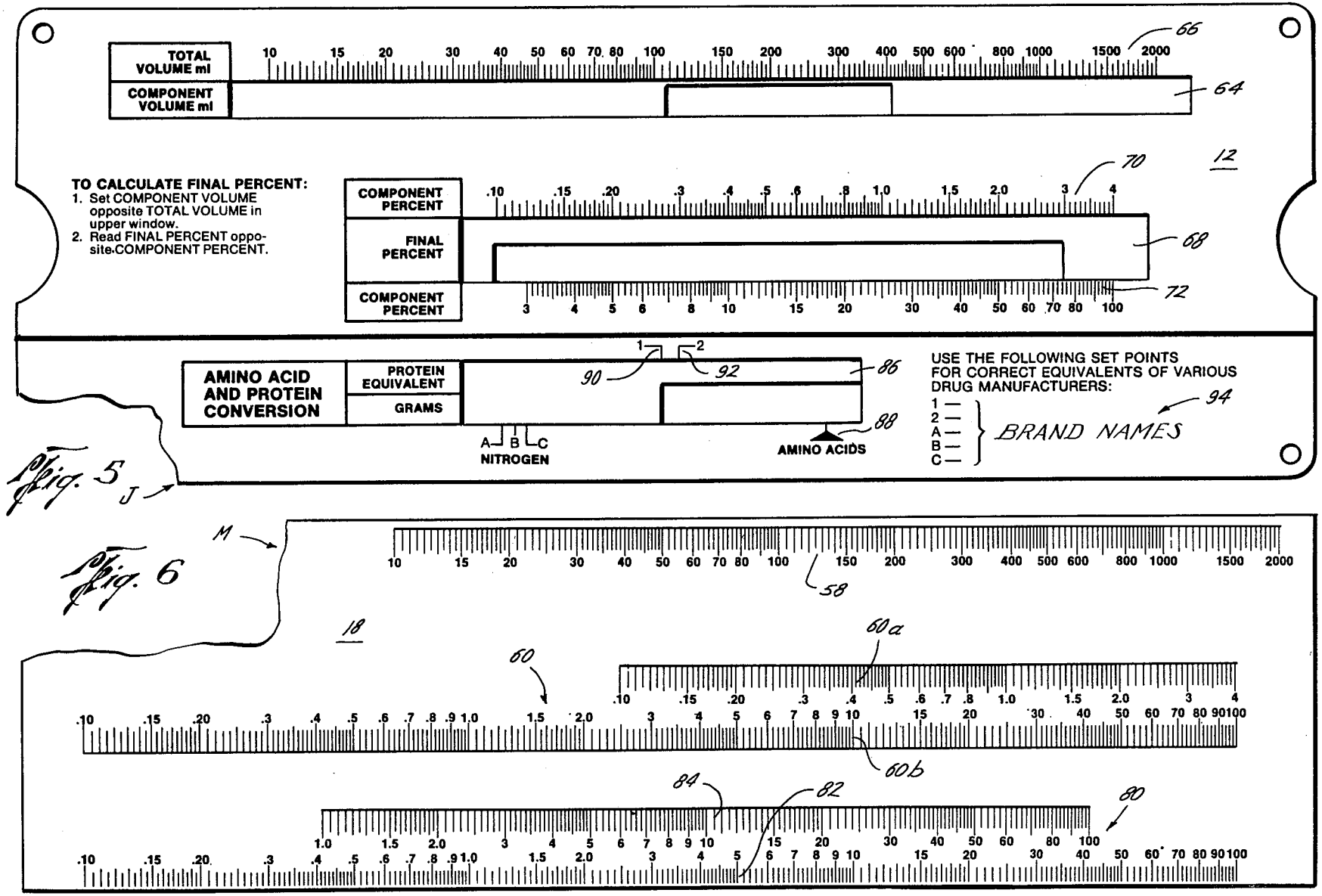
FIG. 5 is a plan view of the panel of FIG. 2.
FIG. 6 is a plan view of the display surface of FIG. 2.

Considering now the final percentage display surface 18 more in detail (FIG. 6), a first scale 58 is set forth thereon defining various volumes of a base component in a chosen or proposed nutritive solution is set forth (FIG. 6). A two part second scale 60, including an upper scale portion **60*a* and a lower scale portion 60*b* is also formed on the display surface 18** defining two ranges of the final percentage of the hyperalimentation solution represented by a chosen or proposed component thereof.

The percentage indicator face panel 12 has an aperture 64 formed therein adjacent the first scale 58, permitting viewing of the scale 58. Indicia 66 in the form of a scale defining various total volumes of hyperalimentation solution to be administered are formed adjacent the aperture 64.

A second aperture 68 is formed in the percentage indicator face panel 12 adjacent the scale 60 permitting viewing of scale 60. Indicia in the form of component scales 70 and 72 defining various percentages of components of the hyperalimentation solution are formed on the face panel 12 adjacent the aperture 68. In this manner, for a hyperalimentation solution having a component with a particular volume and a stated or chosen total volume of solution, the slide member M may be moved with respect to the jacket member J so that the component volume on the scale 58 may be aligned with the indicia 66 adjacent the aperture 64. When the component volume on the scale 58 and the indicia 66 for the given total volume of the hyperalimentation solution are aligned, the final percentage of the component in the solution may be determined from one of the two parts of the second scale 60 using either the indicia 70 and 72 adjacent the aperture 68, as required. The component percentage of the component is found on the scale 70 or 72 as the case may be, and the final percentage of the component in the solution is determined from the reading on the scale **60*a* or 60*b***. In this manner, the final percentage of a component in a stated or proposed hyperalimentation solution may be determined.

In prescribing hyperalimentation solutions, it is also at times desirable to determine the protein equivalency of a particular amino acid being administered. Accordingly, the slide rule includes a protein equivalency nomograph 80 (FIG. 6) preferably formed on the final percentage display surface 18, although it should be understood that the nomograph 80 may be included on the calorie indicator display surface 16, if desired. The nomograph 80 includes a scale 82 defining a range of amino acid concentrations typically present in hyperalimentation solutions and a scale 84 setting forth a range of protein equivalence for the amino acid concentrations on the scale 82. An equivalency aperture 86 is formed in the jacket member J adjacent the equivalency nomograph 80, and indicia including a pointer 88 and markers 90 and 92 are formed adjacent the aperture 86 to permit determination of the protein equivalent of the amino acid in the hyperalimentation solution. The markers 90 and 92 identify, as defined in a brand name chart 94, the particular protein equivalence for a particular strength amino acid from one of several drug manufacturers, based on the relationship between brand names and the chart 94 and the designators applied to the markers 90 and 92. Since the particular brand names for the solutions currently being marketed do not comprise a part of the present invention, they have been omitted from the chart 94 and designated generally "BRAND NAMES."

Further, it is sometimes desirable in prescribing hyperalimentation solutions to determine the nitrogen equivalent of a particular amino acid. Accordingly, indicators 96, 98 and 100 are formed adjacent the aperture 86 at locations so that, for particular brand names as indicated by the chart 94, the available nitrogen in the amino acids from various drug manufacturers being prescribed for hyperalimentation solutions may be determined.

OPERATION OF THE INVENTION

In the operation of the present invention, it is considered helpful to discuss the operation in terms of certain specific examples illustrating the determination of available calories and final percentages using the slide rule of the present invention.

EXAMPLE 1

An order is written for a patient John Doe for intravenous hyperalimentation. The base component solutions consist of 500 ml of crystalline L-amino acid solution 8.5% (CLAA) and 500 ml D-50-W (50% Dextrose in water). The electrolyte additives include NaCl (Sodium Chloride), $KH_2PO_4$ (Potassium Phosphate), K+Acetate (Potassium Acetate), $MgSO_4$ (Magnesium Sulfate) and Ca Gluconate (Calcium Gluconate). The volume contributed by the additive electrolytes is 50 ml. In order to determine the final percent concentrations of the base components, the total volume of the order is first determined and the following steps are performed:

1. Move slide member M with respect to jacket member J to align component volume of CLAA (500 ml) on scale 58 with the total volume of the solution (1050 ml) on indicia 66 on percentage indicator face 12.
2. Locate the component percentage of the CLAA on scale 70 (or 72, if required).
3. Read the final percentage of CLAA from scale 60 at location directly opposite the component percent (8.5%).

The final percent of CLAA is 4.0%.

4. Repeat steps "1" through "3" to determine the final percent dextrose in solution. The component volume of dextrose is 500 ml; the component percent is 50%.

The final percent of dextrose in solution is 23.8%.

EXAMPLE 2

An order is written for intravenous hyperalimentation therapy with the following constituents:

| | |
|---|---|
| CLAA 8.5% | 175 ml |
| D-50-W | 150 ml |
| Sterile $H_2O$ | 50 ml |

The electrolyte additives account for a total volume of 25 ml. To determine the resulting percentage of each nutrient solution, first determine the total volume of the order (400 ml). Repeat steps "1" through "3" of EXAMPLE 1, using appropriate values for component volumes and component percents, the following final results for each base is obtained:

| BASE | COMPONENT VOLUME | COMPONENT % | FINAL % |
|---|---|---|---|
| 1. CLAA | 175 ml | 8.5 | 3.7 |
| 2. DEXTROSE | 150 ml | 50 | 18.8 |

EXAMPLE 3

A solution of 500 ml CLAA 8.5% and 500 ml D-50-W is prepared for a patient. To determine how many calories are contributed from each solution and the total caloric content of the admixture, the following steps are performed:

1. Move slide member M with respect to jacket member J to align the component percent CLAA (8.5%) with the arrow 30 on calorie availability display face 10 adjacent nomograph 20.
2. Read the corresponding caloric value per milliliter of solution from scale 22 (0.34 calories per ml).
3. Again move slide member M with respect to the jacket member J to align the caloric value answer of step "2" with the arrow 50 on display 10.
4. Without moving the slide member from step "3", read the total calories from chart 42 aligned with the appropriate component volume from indicia 54.

The total calories contributed by CLAA is 70.

5. Repeating steps "1" through "4" for the dextrose component, the calories per ml for dextrose 50% is 1.7 from arrow 30 and the total calories contributed by dextrose is 850 from chart 42. Combining these totals, the total caloric content may be obtained: 20 calories.

EXAMPLE 4

A pediatric formulation for parenteral nutrition contains the following additives:

| | |
|---|---|
| CLAA 8.5% | 100 ml |
| D-50-w | 50 ml |
| D-5-W | 75 ml |

To determine the total caloric content of this formulation and the final percentage of dextrose and amino acids in the total volume of solution I, perform the following steps:

1. Perform steps "1" through "4" of EXAMPLE 3, for CLAA 8.5%, D-50-W, and D-5-W to determine the total calories of each component.

The chart below summarizes these results:

| BASE | COMPONENT % | CALORIES/ ml | TOTAL COMPONENT CALORIES |
|---|---|---|---|
| CLAA | 8.5 | 0.34 | 34 |
| Dextrose | 50 | 1.7 | 85 |
| Dextrose | 5 | 0.17 | 13 |

TOTAL = 34 + 85 + 13 = 132 TOTAL CALORIES

2. The final percents of each component in the total volume are determined by determining total volume (225 ml) and repeating steps "1" through "3" of EXAMPLE 1.

The chart below summarizes the results:

| BASE | COMPONENT VOLUME | COMPONENT % | FINAL % |
|---|---|---|---|
| CLAA | 100 ml | 8.5 | 3.8 |
| Dextrose | 50 ml | 50 | 11.1 |
| Dextrose | 75 ml | 5 | 1.7 |

The final percentage of CLAA is 3.8%.
The final percentage of dextrose is 12.8%.

It should be understood that the foregoing disclosure and description of the present invention are illustrative and explantory thereof and various changes in the size, shape and materials as well as in the description of the preferred embodiment may be made without departing from the spirit of the invention.

We claim:

1. A slide rule for computation of dosages in prescribing hyperalimentation solutions, comprising:
(a) a jacket member having a percentage indicator face panel and a calorie indicator face panel;
(b) a slide member movable in said jacket member and having a final percentage display surface and a calorie availability display surface formed thereon;
(c) said final percentage display surface having thereon a first scale defining various volumes of a component of the hyperalimentation solution;
(d) said percentage indicator face panel of said jacket member having a first aperture therein adjacent said first scale of said final percentage display surface, permitting viewing of same;
(e) said percentage indicator face panel of said jacket member having a total volume scale formed thereon adjacent said first aperture, defining total volumes of the hyperalimentation solution, for alignment with said first scale of said final percentage display surface;
(f) said final percentage display surface further having thereon a final percentage scale defining the final percentage of the hyperalimentation solution represented by a component thereof;
(g) said percentage indicator face panel of said jacket member further having a second aperture formed therein adjacent said second scale of said final percentage display surface permitting viewing of same;
(h) said percentage indicator face panel further having a component percentage scale formed thereon adjacent said second aperture, defining component percentages of components of the hyperalimentation solution, for alignment with said final percentage scale; and
(i) said final percentage scale being formed on said final display surface and said second aperture being located on said jacket member at locations wherein for a chosen hyperalimentation solution said slide member is movable with respect to said jacket member to permit said component volume scale to be aligned with said total volume scale so that the final percentage of the component in the solution may be determined from that portion of said final percentage aligned with said component percentage scale; and
(j) said calorie availability display surface having formed thereon;
(1) a component percentage scale indicating component percentage solution of a hyperalimentation solution; and
(2) a calories per unit volume scale defining calories per unit volume for solutions;
(k) said calorie indicator face panel of said jacket member having a first aperture therein for viewing of said component percentage scale and said calories per unit volume scale;
(l) said calorie indicator face panel having:
(1) a first indicator formed thereon adjacent said first aperture for alignment with said component percentage scale for a chosen hyperalimentation solution; and
(2) a designator formed thereon adjacent said calories per unit volume scale for determination of the available calories per unit volume from the chosen hyperalimentation solution when said first indicator is aligned with a number on said component percentage scale of the chosen hyperalimentation solution;
(m) said calorie availability display surface further having thereon:
(1) a total calories scale defining total calories available in a hyperalimentation solution; and
(2) a second calories per unit volume scale displaying calories per unit volume;
(n) said calorie indicator face panel of said jacket member further having at least one other aperture formed thereon for viewing of said total calories scale and said second calories per unit volume scale; and
(o) said calorie indicator face panel further having:
(1) an indicator formed thereon adjacent said at least one other aperture for alignment with said second calories per unit volume scale; and
(2) component scales defining various component volumes for alignment with said total calories scale, wherein for a chosen hyperalimentation solution said inner slide member is moveable with respect to said jacket member to align said component percentage scale with said first indicator and permit the calories per unit volume to be determined from said designator adjacent said calories per unit volume scale and therefrom to determine the total calories available by alignment of said second calories per unit volume scale with said indicator adjacent said at least one other aperture so that total calories for a component volume defined by said component scales may be read from said total calories scale.

2. The structure of claim 1, wherein the given hyperalimentation solution contains hydrous dextrose and wherein:
said designator formed adjacent said first aperture on said calorie indicator face panel includes a marker for alignment with said available calories scale for determination of available calories per unit volume of hydrous dextrose.

3. The structure of claim 1, wherein the given hyperalimentation solution contains amino acids and wherein:
said designator formed adjacent said first aperture on said calorie indicator face panel includes a marker for alignment with said available calories scale for determination of available calories per unit volume of amino acids.

4. The structure of claim 1, wherein the hyperalimentation solution contains amino acids and wherein:
(a) said inner slide member further includes an equivalency scale defining the protein equivalent of an amino acid;

(b) said jacket member has an equivalency aperture formed therein adjacent said equivalency scale; and (c) said jacket member further has indicia formed thereon adjacent said equivalency aperture to determine from said equivalency scale the protein equivalent of the amino acid in the hyperalimentation solution.

5. The structure of claim 4, wherein said jacket member further has indicia formed thereon adjacent said equivalency aperture to define the available nitrogen in the amino acid in the hyperalimentation solution.

6. A slide rule for computation of dosages in prescribing hyperalimentation solutions, comprising:

(a) a jacket member having a calorie indicator face panel;

(b) a slide member movable in said jacket member and having at least a calorie availability display surface formed thereon;

(c) said calorie availability display surface having formed thereon:

(1) a component percentage scale indicating component percentage solution of a hyperalimentation solution; and (2) a calories per unit volume scale defining calories per unit volume for solutions;

(d) said calorie indicator face panel of said jacket member having a first aperture therein for viewing of said component percentage scale and said calories per unit volume scale;

(e) said calorie indicator face panel having:

(1) a first indicator formed thereon adjacent said first aperture for alignment with said component percentage scale for a chosen hyperalimentation solution; and (2) a designator formed thereon adjacent said calories per unit volume scale for determination of the available calories per unit volume from the chosen hyperalimentation solution when said first indicator is aligned with a number on said component percentage scale of the chosen hyperalimentation solution;

(f) said calorie availability display surface further having thereon:

(1) a total calories scale defining total calories available in a hyperalimentation solution; and (2) a second calories per unit volume scale displaying calories per unit volume;

(g) said calorie indicator face panel of said jacket member further having at least one other aperture formed thereon for viewing of said total calories scale and said second calories per unit volume scale; and (h) said calorie indicator face panel further having:

(1) an indicator formed thereon adjacent said at least one other aperture for alignment with said second calories per unit volume scale; and (2) component scales defining various component volumes for alignment with said total calories scale, wherein for a chosen hyperalimentation solution said inner slide member is moveable with respect to said jacket member to align said component percentage scale with said first indicator and permit the calories per unit volume to be determined from said designator adjacent said calories per unit volume scale and therefrom to determine the total calories available by alignment of said second calories per unit volume scale with said indicator adjacent said at least one other aperture so that total calories for a component volume defined by said component scales may be read from said total calories scale.

* * * * *